United States Patent [19]

George et al.

[11] 4,029,240

[45] June 14, 1977

[54] GARMENT HANGER

[76] Inventors: Paul J. George, P.O. Box 86, Brecksville, Ohio 44141; M. Ted Raptes, 2111 Jefferson Davis Hwy., Arlington, Va. 22202

[22] Filed: Oct. 8, 1975

[21] Appl. No.: 620,719

Related U.S. Application Data

[63] Continuation-in-part of Ser. No. 401,292, Sept. 27, 1973, Pat. No. 3,923,213.

[52] U.S. Cl. ..... 223/96; 24/261 C

[51] Int. Cl.[2] ..... A47J 51/14

[58] Field of Search ..... 223/96, 91, 85, 87; 211/113; 24/261 C, 137 R, 67.9

[56] References Cited

UNITED STATES PATENTS

| | | | |
|---|---|---|---|
| 505,726 | 9/1893 | Scott | 24/261 C |
| 1,454,213 | 5/1923 | Chapman et al. | 24/261 C |
| 2,200,669 | 5/1940 | Cook | 223/96 |
| 2,473,898 | 6/1949 | Muntwyler et al. | 223/96 |
| 2,583,020 | 1/1952 | Smith | 24/255 GP |
| 3,589,573 | 6/1971 | Battles | 223/96 |
| 3,744,686 | 7/1973 | Levitin | 223/96 |

*Primary Examiner*—George H. Krizmanich

[57] ABSTRACT

A garment or pants hanger is provided comprising looped arcuate yoke means having horizontally disposed grippers at each end adapted to grip the garment, and suspending means connected to said yoke means for suspending the hanger. The yoke means has a spring action and maintains the grippers in a closed position to frictionally retain a garment therebetween. The grippers are opened by squeezing the sides of the yoke means. The hanger can be manufactured as a flat development member by molding or stamping, which is then looped on itself to form the hanger. Plastic or metal having a spring action is suitable for the manufacture of the hanger.

7 Claims, 6 Drawing Figures

GARMENT HANGER

BACKGROUND OF THE INVENTION

This application is a continuation-in-part of copending application Ser. No. 401,292, filed Sept. 27, 1973 and now U.S. Pat. No. 3,923,213 issued Dec. 2, 1975.

This invention relates to a novel improved, simplified garment hanger, and more particularly to a device for gripping and hanging clothing articles such as trousers, skirts and the like.

Conventional prior art garment hangers, readily available, are usually made from wire or wood and combinations thereof. Most of the well known types of hangers grip the trousers near the cuffs and permit the trouser to hang free therefrom. This type of hanger is shown in U.S. Pat. Nos. 3,070,270; 3,262,617 and 3,362,594. Other types of hangers are adapted to fit into the cuffs of trousers, or the hanger is adapted to grip, by an external squeezing action a top part of a garment or the cuffs of trousers. These devices, although accomplishing the desired result, are somewhat complicated and cumbersome to use and relatively expensive to manufacture, requiring several components to be assembled together.

BRIEF SUMMARY OF THE INVENTION

An object of this invention is to provide a simplified garment or pants hanger adapted to simply grip a top portion of the garment permitting it to hang freely.

Another object of this invention is to provide a simplified garment or pants hanger made completely of a plastic or metal material.

A further object of this invention is to provide a simplified garment or pants hanger comprising a yoke member having a spring action, which is characteristic of the plastic or metal used to manufacture the hanger, and grippers for gripping a portion of the garment.

Another object of this invention is to provide a garment or pants hanger comprising looped arcuate yoke means having grippers at each end which are maintained in a closed position by the spring action of the yoke means.

A further object of this invention is to provide a flat development hanger member adapted to be formed into a hanger, which is manufactured by molding from a plactic material or stamping from a metal.

Another object of this invention is to provide a garment or pants hanger wherein the operation of the hanger is simple and direct, permits a garment to be gripped, or permits a garment to be released, in one simple action.

The above objects along with others will be readily apparent by referring to the following description of preferred embodiments thereof, taken in conjunction with the accompanying drawings.

DETAILED DESCRIPTION OF THE INVENTION

Figure 1:
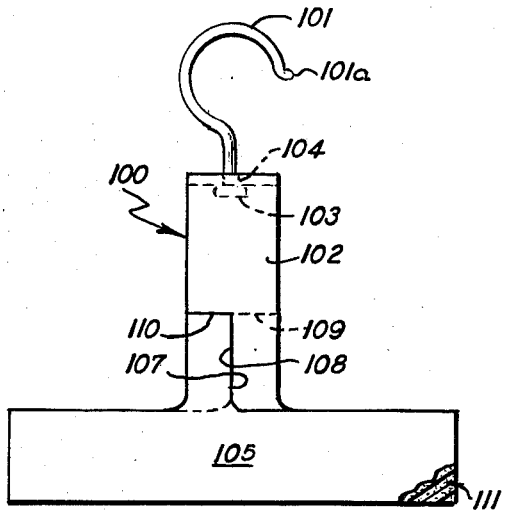
FIG. 1 is a side elevational view of the garment hanger of this invention.

Referring to the drawing, the numeral 100 generally denotes a specific embodiment of the manufactured hanger of the invention from plastic or metal. The hanger 100 is manufactured by usual methods as by molding or stamping. In the case of a plastic material, the garment hanger can be molded or hot-stamped out of a calendered plastic sheet. Where a metal sheet is used, the garment hanger is pressure stamped. In both cases, the hanger is made with the one operation.

Figure 3:
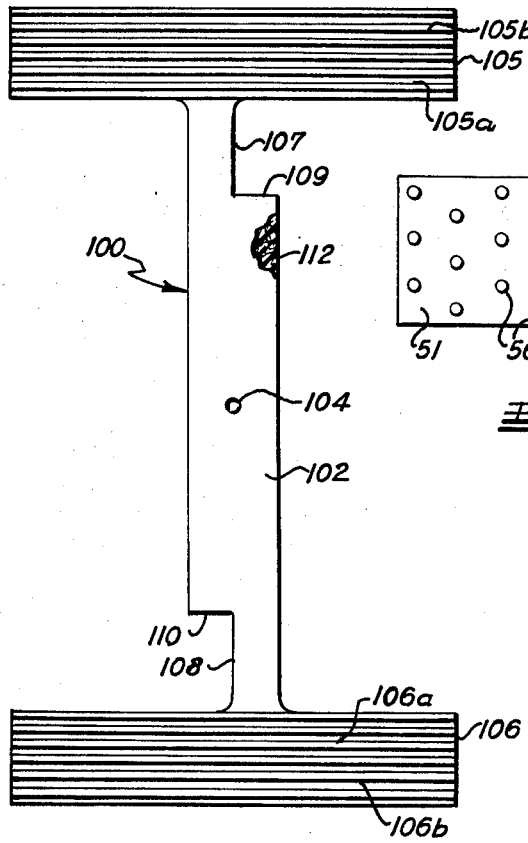
FIG. 3 is a plan view of the development member of the garment hanger of FIGS. 1 and 2.

Hanger 100 can be manufactured as a unitary flat development member **100*a*, having an I-configuration, by molding or stamping as shown in FIG. 3, and comprises a yoke section 102, and grippers 105 and 106 containing gripping surfaces and gripping means 105*a* and 106*a* having gripping means 105*b* and 106*b*, respectively, on the same side of the development member 100*a*. The yoke 102 has two cutout sections 107 and 108 having edges 109 and 110, respectively. The cutout sections are generally rectangular in configuration. The yoke 102 is provided with a hole 104 at its midpoint. The hanger 100 is preferably manufactured completely from a plastic material as by molding. Although a plastic material is preferred, the development hanger member 101*a* can be manufactured from sheet metal as will be more fully explained hereinafter. In any event, the plastic material or metal is selected so as to provide a spring action to the yoke 102** when it is flexed.

Figure 2:
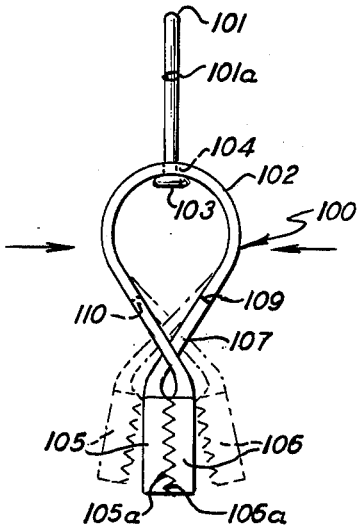
FIG. 2 is an end elevational view of the garment hanger shown in FIG. 1 and showing its operation.

The development member **100*a* manufactured, as shown in FIG. 3, is then formed into a hanger. This is done by flexing the yoke 102 so that it loops on itself with the two cutout sections 107 and 108 engaging each other as shown in FIGS. 1 and 2. The grippers 105 and 106 respective gripping surfaces and gripping means engage each other and are kept in engagement by the spring action of the arcuate, looped yoke. The grippers can be separated or opened by squeezing both sides of the midportion of the looped yoke. Edges 109 and 110** act as stops for the maximum separation of the grippers.

The formed hanger 100 comprises suspending means for hanging the hanger on a horizontal pole, a wall hook, etc. The suspending means shown in the embodiment described is a hook 101 which is adapted to be connected by suitable means to the yoke. As shown, the end 103 of the hook is a knob, which retains the hook, after it has been inserted through the leading end **101*a* in the hole 104 of the yoke. Although, the hook 101 is shown as being removable, it is within the scope of the invention to permanently secure the end of the hook in hole 104** by suitable means. Alternatively, the hanger can be provided with other types of suspending means to suspend the hanger from various means. Thus, for example, a ring (not shown) can be permanently secured to the yoke of the hanger, and the ring can be fitted over a horizontal pole, whereby the hanger is movable across the pole but not removable therefrom.

When using hanger 100 for hanging garments, the two cuffs of trousers, or the hems of a skirt, are put together, the midsection of the sides of the yoke are squeezed together (as shown by the direction of the arrows in FIG. 2) to separate the grippers 105 and 106, and while separated, the cuffs or hems are placed between the grippers, the pressure on the sides of the yoke is released thereby permitting the grippers to grip or clamp the cuffs or hems between them, whereby the remainder of the garment is allowed to hang free. The hanger and garment can then be hung on a horizontal clothes pole, or the like, by means of the hook 101. When it is desired to remove the trousers, skirt, etc., from the hanger, it is not necessary to remove the hanger from the clothes pole, it being merely necessary to squeeze the yoke again, as described, to separate the grippers and to remove the garment, the hanger can remain on the clothes pole.

Figure 4:
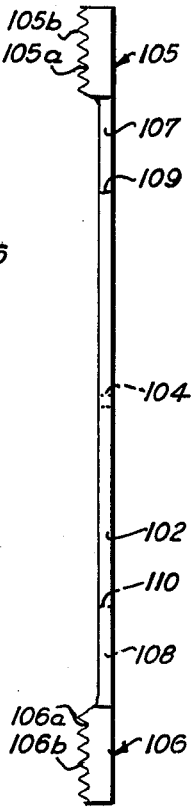
FIG. 4 is an end view of the development member shown in FIG. 3.

The embodiment of the gripping means, **105*b* and 106*b*, shown in FIGS. 2, 3 and 4 are adapted to frictionally hold a garment by the squeezing spring action of the looped yoke 102 when the grippers are in the closed position. Surfaces 105*a* and 106*a* comprise a series of parallel longitudinal ridges, 105*b* and 106*b*** respectively, preferably angled slightly upwardly which act as frictional gripping means.

Figure 5:
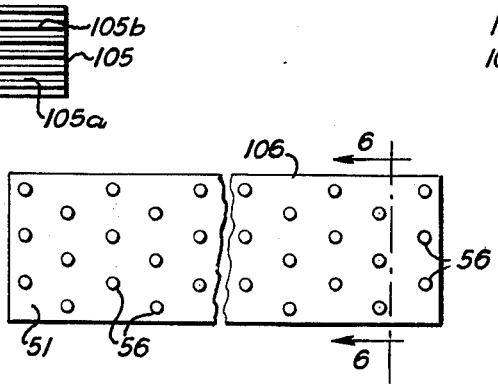
FIG. 5 is a side elevational view of only one gripper member for clarity showing a second embodiment of frictional gripping means on the gripping surfaces as used with the garment hanger of the invention.
Figure 6:
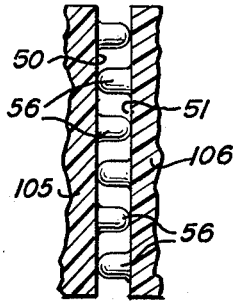
FIG. 6 is a sectional view taken along lines 6—6 of FIG. 5, but showing both grippers with the gripping surfaces in engagement.

In FIGS. 5 and 6, there is depicted a second embodiment of frictional gripping means than those shown in FIGS. 2,3, and 4. The gripping surfaces 50 and 51, of grippers 105 and 106 respectively, as particularly shown in FIG. 6, comprise a plurality of round, small protuberances 56 on each gripper surface, spaced in a grip pattern in non-opposed relationship to each other on each surface. The protuberances 56 engage the opposite surfaces and not each other when the grippers 105 and 106 are in engagement. The arrangement of protuberances 56 provides a positive and frictional gripping action on garments. The protuberances 56 can be formed during the molding or stamping of the development member.

In addition to the frictional gripping means shown, other frictional gripping means (not shown) can be used on the gripping surfaces. Thus, gripper surfaces **105*a* and 106*a* can have a gripping material such as felt of "Velcro" material disposed by suitable means thereon. With the use of felt of "Velcro" material, the grippers 105 and 106 can be molded with flat surfaces 105*a* and 106*a*** on which the felt and "Velcro" can be secured ("Velcro" is a registered trademark of the Velcro Corporation).

The above described hanger can be easily manufactured or fabricated from plastic materials by any of the usual methods which are suitable or applicable, such as, injection molding or calendering. Thus, it can hot-stamped out of a calendered plastic sheet. Certain parts, such as the hook, can be easily formed by injection molding. The spring action of the yoke, and its requirement that sufficient gripping action be supplied to the grippers, requires plastic materials having specific properties which are available on the market. Particularly suitable because of their low cost are PVC (polyvinylchloride), ABS (acrylonitrile-butadiene-styrene), PS (polystyrene), PE (polyethylene), and PP (polypropylene). All of these offer a wide range of properties and processing characteristics making them desirable for fabrication into the articles of this invention. Besides the advantage of being low-cost resins, each of these is capable of modification by the incorporation of suitable additives, fillers, or reinforcing agents well known in the trade to enable one to achieve any combination of properties desired in the final plastic part. For example, the stiffness of PP can be greatly increased by the incorporation of suitable fillers, shown at 111 in FIG. 1, such as glass fibers, talc, or asbestos. The tensile strength and the rigidity of PE, especially the high density of PE's, can be readily increased by the addition of reinforcing fillers such as clay or glass fibers. Although PVC possesses one of the best combinations of stiffness and impact strength among the plastics, its properties can be further modified by incorporating glass fibers thermoplastic fibers, or asbestos fibers, as shown at 112 in FIG. 3, to increase dimensional stability. Following is a listing of the filler types which can be used with the plastics in this invention:

| TYPE | EXAMPLES |
|---|---|
| Silica products | Sand, diatomaceous earth, fumed colloidal silica, etc. |
| Silicates | Talc, asbestos, mica, etc. |
| Glass | Glass flakes, spheres, etc. |
| Calcium carbonate | Chalk, precipitated calcium carbonate |
| Metallic oxides | Alumina, titania, zinc oxide, etc. |
| Inorganic compounds | Barium sulfate, molybdenum disulfide |
| Metal powders | Aluminum, bronze, zinc, etc. |
| Carbon | Carbon black, ground petroleum coke |
| Cellulosic fillers | Wood flour, shell flour |
| Comminuted polymers | Phenolic resins, polystyrene, etc. |

The following is a listing of fibrous reinforcement for plastics useful in this invention:

| TYPE | EXAMPLES |
|---|---|
| Cellulose | Rayon, jute, cotton flock -cellulose |
| Asbestos | |
| Carbon | |
| Fibrous glass | Filaments, glass fabric, yarn strand |
| Synthetic fibers | Polyamide (Nylon), polyester (Dacron), polyacrylonitrile (Orlon), polyvinyl alcohol |
| Metallic fibers, whiskers | |

Although, as stated, plastic materials are preferred and are excellently suitable in the manufacture of the hanger of this invention, it is also contemplated that metal which possess a spring action can be used. Suitable metals include steel, aluminum, and the like. Hanger 100 is adaptable for manufacture out of a metal. Thus, the hanger development member **100*a* can be stamped from a metal and the hanger 100** formed similarly as the one formed from a plastic development member.

The simplified garment hanger aside from being easily manufactured has the following advantages. After manufacture, the molded or stamped hanger, as shown in FIGS. 3 and 4, since it has a flat configuration, permits easy packing for shipping and packaging purposes. The formation of the actual hanger as shown in FIGS, 1 and 2 from the development hanger member **100*a* of FIGS. 3 and 4 is a simple operation. Furthermore, the formed, looped hanger 100** can be easily unfolded to a flat configuration for storage or for packing in a suitcase.

Having now described the invention in specific detail and exemplified the manner in which it may be carried into practice, it will be readily apparent to those skilled in the art that innumerable variations, applications, modifications, and extensions of the basic principle involved may be made without departing from its spirit or scope.

What is claimed is:

1. A hanger for gripping and suspending a garment permitting it to hang freely, said hanger formed from a unitary plastic development member which is substantially planar and has a generally I-configuration, said development member comprising an intermediate longitudinal yoke member and a transverse gripper member at each extremity of said yoke means, said yoke means comprising a longitudinal cutout section adjacent each yoke extremity, said cutout sections being on opposite longitudinal sides of said yoke means, said gripper members comprising frictional gripping surfaces having a planar dimensional area disposed on the same side of said planar development member, said development member looped on itself with said gripper members crossed over on each other and said cutout sections are engaged and in abutment with each other, whereby said yoke means is maintained in a generally longitudinal arcuate looped form having a spring biasing action, and whereby said gripping surfaces of said gripper members are maintained in a face to face parallel closed position with each other by said spring biasing action, a removable suspending means for said development member connected to the upper portion of said arcuate yoke means, whereby said gripper members can be separated by a squeezing action on both sides of said arcuate yoke means to thereby enable a garment to be inserted between said gripping surfaces of said gripper members and to be frictionally held therebetween by said gripping surfaces upon release of said squeezing action on said arcuate yoke means.

2. The hanger of claim 1, wherein said cutout sections include transverse stop means for said gripper means when separated.

3. The hanger of claim 1, wherein said gripper members comprise a material disposed on said gripping surfaces adapted to frictionally retain a garment between said grippers.

4. The hanger of claim 1, wherein said gripper members comprise parallel, horizontal ridges on said frictional gripping surfaces.

5. The hanger of claim 1, wherein said gripper members comprise a grid pattern of a plurality of small protuberances on said frictional gripping surfaces.

6. The hanger of claim 1, wherein said suspending means is a rod type hook adapted to be removably inserted and secured in hole means disposed in the upper portion of said arcuate yoke means.

7. The hanger of claim 1, wherein said development member is molded from a plastic material having a spring-action property.

* * * * *